United States Patent [19]

Sullaway

[11] 4,230,424

[45] Oct. 28, 1980

[54] LEG CLOSURE

[75] Inventor: Bob L. Sullaway, Duncan, Okla.

[73] Assignee: Halliburton Company, Duncan, Okla.

[21] Appl. No.: 71,439

[22] Filed: Aug. 31, 1979

[51] Int. Cl.[3] ..... E02D 5/52

[52] U.S. Cl. ..... 405/227; 405/225; 138/89

[58] Field of Search ..... 405/224–227, 405/195, 203, 204; 138/89–94; 285/229, DIG. 2; 277/235 R

[56] References Cited

U.S. PATENT DOCUMENTS

| | | | |
|---|---|---|---|
| 3,533,241 | 10/1970 | Bowerman et al. | 405/227 X |
| 4,024,723 | 5/1977 | Mayfield et al. | 405/227 |
| 4,047,391 | 9/1977 | Mayfield et al. | 405/225 |
| 4,178,112 | 12/1979 | Knox | 405/224 X |

*Primary Examiner*—Dennis L. Taylor

*Attorney, Agent, or Firm*—James R. Duzan; John H. Tregoning

[57] ABSTRACT

A diaphragm for closing the bore of a tubular pile guide member and/or supporting leg member of a marine platform or similar structure, the diaphragm comprising reinforced elastomeric material having fabric type reinforcing means bonded to one or more reinforcing members in the outer periphery of the diaphragm and extending throughout the diaphragm with additional fabric type reinforcing means bonded to one or more reinforcing members or the fabric type reinforcing means in the periphery of the diaphragm and extending inwardly into the inner portion of the diaphragm without extending throughout the diaphragm.

23 Claims, 7 Drawing Figures

LEG CLOSURE

This invention relates to an improved closure diaphragm for offshore platforms used in well drilling and production.

Offshore platforms are generally fabricated in a harbor or on a shore location and are then towed to a marine site where they are tipped on end and lowered into position with the platform resting on the ocean floor. The platform legs are hollow structures having open ends so that pilings can be driven downwardly through the legs into the subterranean formations below the ocean floor to anchor the platform in position.

It is desirable during platform setting operations to utilize the platform legs and/or pile sleeves for buoyancy and to exclude foreign material from the platform leg to prevent the annulus between the piling and platform leg from becoming contaminated with foreign material which would prevent filling of the annulus with cement or grout. Therefore, a closure structure which is easily severable when the piling is driven through the platform leg and/or pile sleeve is used to seal the end of the platform leg and/or pile sleeve during setting of the platform.

One type of prior art leg closure is illustrated in U.S. Pat. No. 3,533,241 and comprises a circular diaphragm of reinforced elastic material having an annular reinforcing element of circular cross-sectional shape molded in the periphery of the diaphragm with the diaphragm being secured to the leg of the platform by means of two annular plates, each plate having an annular groove of semicircular cross-sectional shape therein for confining the annular reinforcing element in the periphery of the diaphragm between the two annular plates. The semicircular grooves in the two annular plates are of slightly less radial diameter than the periphery of the diaphragm having the annular reinforcing element therein to confine the diaphragm periphery between the two annular plates by slightly deforming it. The reinforcing plies in the diaphragm are alternately wrapped and bonded about the reinforcing element in the periphery of the diaphragm to form a bead of circular cross-sectional shape about the diaphragm periphery without the ends of piles extending into the inner portion of the diaphragm.

While the leg closure illustrated in U.S. Pat. No. 3,533,241 is of simple construction, the leg closure requires the two annular plates to have the semicircular grooves machined therein. For large diameters of leg closures this can be difficult and requires the plies having reinforcing cords therein be alternately wrapped and bonded about the annular reinforcing member which can cause handling problems during molding of the leg closure.

Another type of leg closure illustrated in U.S. Pat. 4,024,723 comprises a circular diaphragm of reinforced elastic material having an annular reinforcing element being of a teardrop cross-sectional shape molded in the periphery of the diaphragm and having a ring of downwardly facing cutter blades molded in the upper surface of the diaphragm to sever the diaphragm when a piling is driven therethrough with the diaphragm being secured to the leg of the platform by means of two annular plates with one plate having an annular groove therein for confining the annular reinforcing element in the periphery of the diaphragm between the two annular plates.

While the leg closure of U.S. Pat. No. 4,024,723 is relatively simple to construct, it requires the addition of cutter blades to be molded in the leg closure which offers resistance when driving the piling through the leg closure and requires the machining of a circular cross-sectional shaped groove in at least one of the two annular plates securing the diaphragm to the leg or sleeve.

Yet another type of leg closure as illustrated in U.S. patent application Ser. No. 914,467, filed June 12, 1978, now U.S. Pat. No. 4,178,112, comprises a diaphragm of reinforced elastic material bonded to a plurality of reinforcing members in the periphery of the diaphragm with the diaphragm being positively secured to the leg of the platform by means of two flat annular plates which have fasteners retaining the diaphragm therebetween via holes therein.

While the leg closure of U.S. patent application Ser. No. 914,467 is relatively simple to construct, it requires a plurality of reinforcing members in the periphery of the diaphragm.

Still yet another type of leg closure as illustrated in U.S. patent application Ser. No. 914,468, filed June 12, 1978, comprises a diaphragm of elastomeric material having reinforcing material wrapped and bonded about one or more reinforcing members in the periphery of the diaphragm with the diaphragm being secured to the leg of the platform by means of two annular plates. The annular plates either have flat confronting faces which have fasteners retaining the diaphragm therebetween via holes therein or have flat confronting faces with inwardly tapered enlarged ends to retain the leg closure therebetween by means of an interference fit therewith.

While the leg closure of U.S. patent application Ser. No. 914,468, filed June 12, 1978, is of relatively simple construction, it requires that the material wrapped and bonded about the one or more reinforcing members in the periphery of the diaphragm be carefully wrapped about the reinforcing members to assure the complete bonding of the material in a relatively wrinkle-free state to the reinforcing members and to itself.

In contrast to the prior art leg closures, the leg closure of the present invention comprises a diaphragm of reinforced elastomeric material having fabric type reinforcing means bonded to one or more reinforcing members in the outer periphery of the diaphragm and extending throughout the diaphragm with additional fabric type reinforcing means bonded to one or more reinforcing members or the fabric type reinforcing means in the periphery of the diaphragm and extending inwardly into the inner portion of the diaphragm without extending throughout the diaphragm. The present invention further comprises a diaphragm of reinforced elastomeric material wherein the cross-sectional thickness of the members in the outer periphery may be varied to optimize the manufacturing cost of the diaphragm while maintaining adequate peripheral strength of the diaphragm. The diaphragm is secured to the jacket leg or pile sleeve of the platform by means of two annular plates with the annular plates having confronting faces which have fasteners retaining the diaphragm therebetween via holes therein. Alternately, the diaphragm may be secured to the jacket leg or pile sleeve of the platform by means of two annular plates having flat confronting faces with inwardly tapered enlarged ends to retain the leg closure therebetween by means of an interference fit therewith.

The advantages and the preferred embodiments of the present invention will be understood from the following specification taken in conjunction with the accompanying drawings wherein:

FIG. 7 is an enlarged broken cross-sectional view of a fifth embodiment of the present invention.

Figure 1:
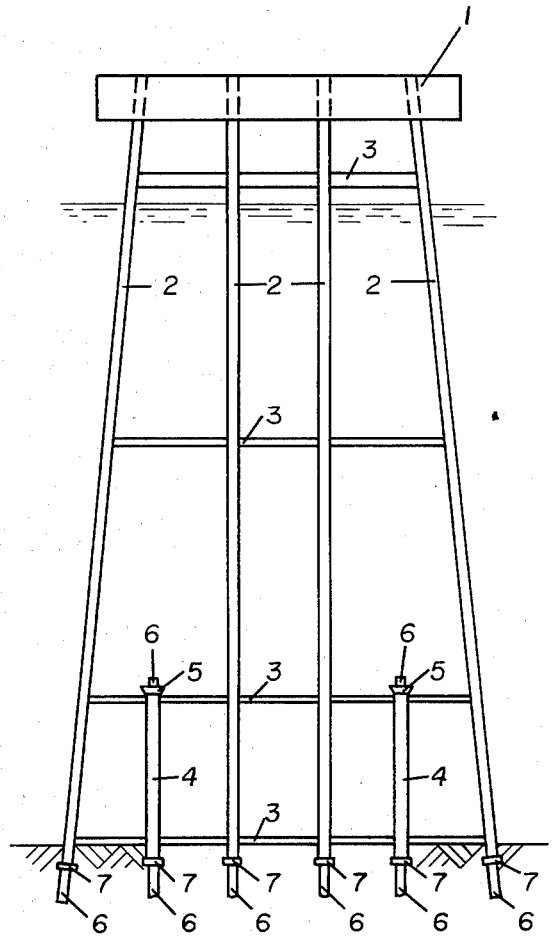
FIG. 1 is a side elevational view of a marine platform having tubular supporting legs and piling guide sleeves between the legs resting on the bottom of a body of water with the present invention installed on the lower end of the legs and sleeves.

Referring to FIG. 1, the present invention is shown installed on a marine platform. A marine platform 1 is shown having tubular supporting legs 2 between which horizontal reinforcing members 3 are connected in the usual manner. Tubular piling guide sleeves 4, which may have flared upper ends 5, are supported between the lower end portion of the legs 2 by the lower reinforcing members 3 and, with the legs, are adapted to rest upon or have their lower extremities slightly embedded in the bottom of a body of water.

The sleeves 4 and legs 2 are secured to the earth by driving a piling 6 to refusal into the bottom of the body of water. Upon completion of the pile driving, the annulus between each sleeve 4 and/or leg 2 and its associated piling 6 may be filled with cement or grout to provide a unitary base structure.

Contained on the bottom of each leg 2 and guide 4 is a rupturable seal assembly 7 which embodies the principles of the present invention.

Figure 2:
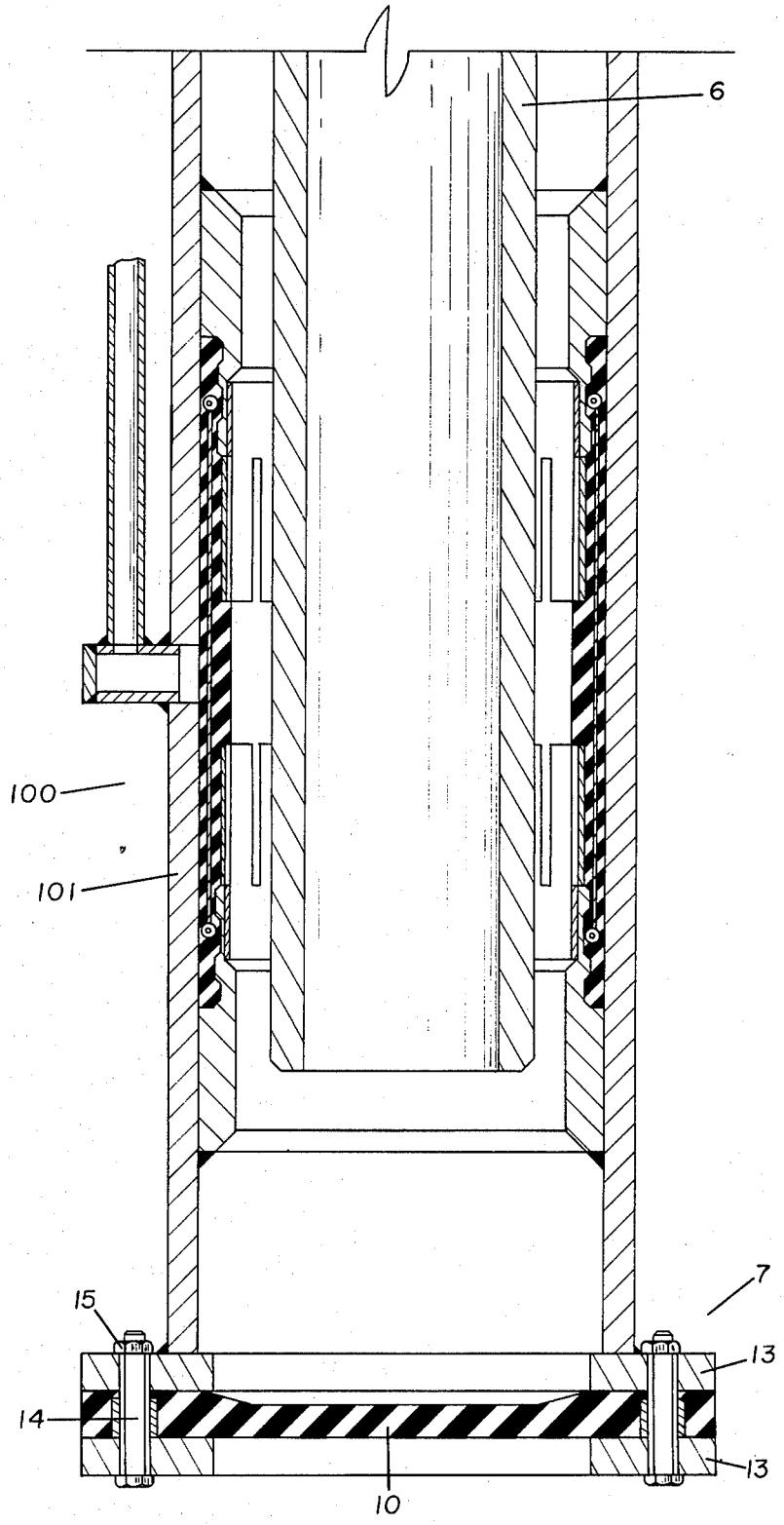
FIG. 2 is a cross-sectional view of the present invention in a typical installation in a leg or piling guide sleeve.

Referring to FIG. 2, the seal assembly 7 is shown in relation to an inflatable packer assembly 100 installed at the bottom of a leg 2 or guide sleeve 4. As shown, the diaphragm 10 is relatively thin compared to its diameter.

For mounting the seal assembly 7 on the lower end of the inflatable packer assembly 100, a pair of flat annular plates 13 is provided which are adapted to be detachably connected about their outer periphery by a plurality of bolts 14 and nuts 15. The upper annular plate 13 is adapted to be secured to the lower end of the packer housing 101 by welding, although any suitable means of securing the plate 13 may be used. If no inflatable packer is installed on the bottom of the leg 2 or guide sleeve 4, alternatively, the plate 13 may be secured to the bottom of the leg 2 or guide sleeve 4.

As shown, the seal assembly closes the lower end of the inflatable packer assembly 100 which is secured to a leg 2 or guide sleeve 4 through which a piling is to be driven to facilitate floating of the platform to its point of installation, as well as preventing entrance of silt and other debris into the leg 2 or guide sleeve 4 during the installation of the platform. To position the platform legs 2 and guide sleeves 4 on the bottom of the body of water, it is necessary to waterflood some or all of the legs 2 and guide sleeves 4. After rupturing of the diaphragm 10 by the piling 6 being driven into the bottom, the diaphragm 10 and the water located thereabove acts to help prevent entry of foreign material into the leg 2 or guide sleeve 4, although during driving of the piling 6, an amount of foreign material will be introduced into the leg 2 or guide sleeve 4.

Figure 3:
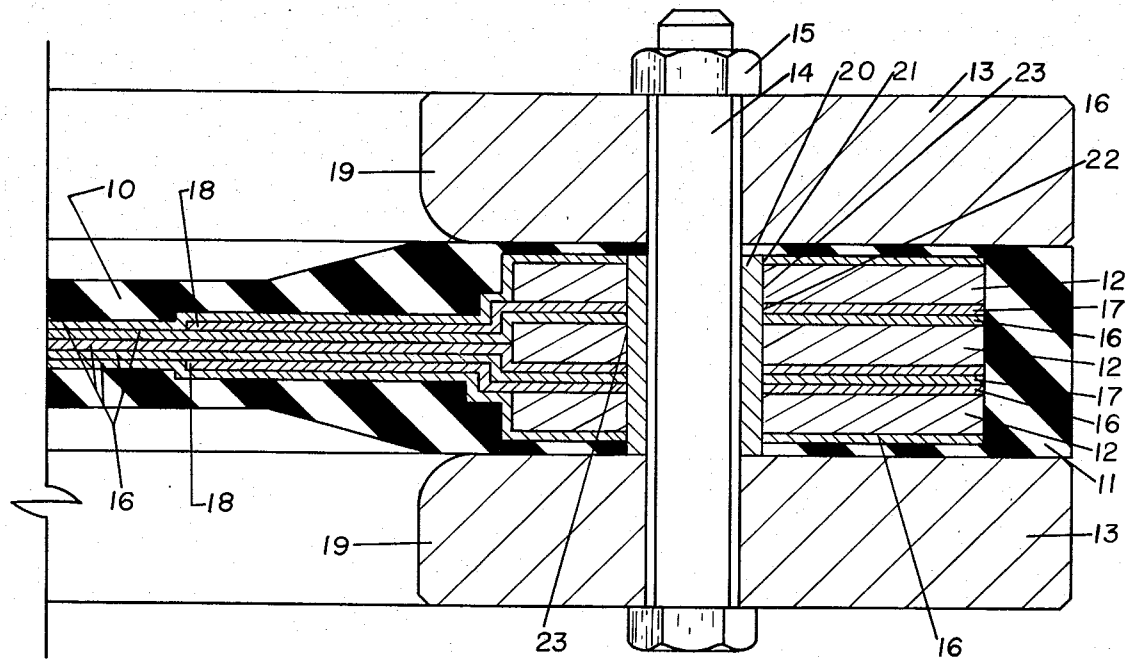
FIG. 3 is an enlarged broken cross-sectional view of a first embodiment of the present invention.

Referring to FIG. 3, a first embodiment of the diaphragm 10 is shown. The diaphragm 10 comprises a flexible member of rubber, synthetic rubber or other suitable elastomeric material. To reinforce the diaphragm 10, a plurality of layers 16 of fabric are bonded in the diaphragm 10 with the outer periphery of the layers 16 of fabric being bonded to metal reinforcing members 12. To further reinforce the diaphragm 10, a plurality of layers 17 of fabric are bonded in the diaphragm 10 to layers 16 of fabric and metal reinforcing members 12. The layers 17 of fabric extend from the outer periphery of the diaphragm 10 inwardly and terminate in the inner portion of the diaphragm 10, such that when the diaphragm 10 is installed between the flat annular plates 13, the layers 17 of fabric terminate inwardly of the inner diameter 19 of the plates 13. Any number of layers 16 or 17 of fabric may be used to reinforce the diaphragm 10 depending upon the required strength of the diaphragm, although five (5) layers 16 of fabric and two (2) layers 17 of fabric are shown. The layers 16 and 17 of fabric used to reinforce the diaphragm 10 may be of any suitable material, such as rayon, nylon, steel, a fabric sold under the trademark "KELVAR" by the Du Pont Company, etc., although nylon is preferred.

It should be noted that it is important to have the inner diameter ends 18 of the layers 17 of the fabric used to reinforce the diaphragm 10 extend a distance into the inner portion of the diaphragm when they are bonded in position. When the diaphragm 10 is deflected by the force of the water, the inner portion of the outer periphery 11 contacts the inner radiused edge of the annular flat plate 13 which is secured to the packer housing 101. By having the ends 18 of the layers 17 of the fabric reinforcing the diaphragm 10 terminating inwardly of the annular flat members 13 after they are bonded to the layers 16 of fabric and metal reinforcing members 12, this acts as additional reinforcement for the diaphragm 10 to help prevent any failure of the diaphragm by tearing of the layers 16 of fabric at the outer periphery 11 of the diaphragm 10 which is retained between the annular flat plates 13.

It should be noted that the inner edges 18 of the annular flat plates 13 are radiused to provide a smooth bearing surface for the diaphragm 10 to bear against under loading.

The metal reinforcing members 12 are formed having a generally rectangular cross-sectional configuration. Although the thickness of the metal reinforcing member 12 may vary when considering the cross-sectional thickness of the member in proportion to the cross-sectional width of the member, the cross-sectional thickness of the member should be relatively small in proportion to the cross-sectional width of the member. However, if the cross-sectional thickness of the member 12 is too small when the member 12 is highly stressed, it will initially buckle inwardly causing a wrinkle in the diaphgram 10, thereby allowing fluid to enter the jacket leg 2 or guide sleeve 4 until the loading on the diaphgram 10 is sufficient to tear the layers 16 of fabric. This causes a massive failure of the diaphragm 10 and not merely a leak between the annular flat plates 13. While the flat annular plates 13 securely retain the periphery 11 of the diaphragm 10 having the metal reinforcing members 12 therein to generally prevent buckling of the members 12 under loading, since the diaphragm 10 deflects one of the plates 13 under loading, the periphery 11 of the diaphragm 10, under high loading, will generally allow the members 12 to buckle if not sufficiently strong.

Also present in the periphery 11 of the diaphragm 10 is a plurality of bushings 20 which extend through apertures 21 in the layers 16 of fabric, apertures 22 in the layers 17 of fabric and apertures 23 in the metal reinforcing members 12. The bushings 20 are used to provide apertures through which the bolts 14 are passed thereby eliminating the drilling of the apertures for the bolts 14 in the diaphragm 10. However, if desired, the bushings 20 may be eliminated and the apertures for the bolts 14 merely drilled in the periphery 11 of the diaphragm 10.

As shown in FIG. 3, the diaphragm 10 is formed having three reinforcing members 12 of equal thickness in the outer periphery 11. For example, the reinforcing members 12 can be formed having a one-quarter inch cross-sectional thickness and a two and one-half inch cross-sectional width. Since the strength of the diaphragm 10 is a function, among other things, of the number and size of reinforcing members 12, the outer periphery 11 of the diaphragm as well as the number of layers 16 and 17 of fabric reinforcing the diaphragm, careful attention should be given to the selection of the cross-sectional thickness and width of the reinforcing members 12. The reinforcing members 12 must be of sufficient cross-sectional thickness to prevent the overstressing of the area of reinforcing members 12 surrounding the bores 23 therein during loading of the diaphgram 10, thereby causing the failure of the reinforcing members 12. However, it should be noted that if the reinforcing members 12 have too thick a cross-sectional thickness, problems could be encountered in bonding the layers 16 and 17 of fabric to the inner diameter of the reinforcing members 12.

Figure 4:
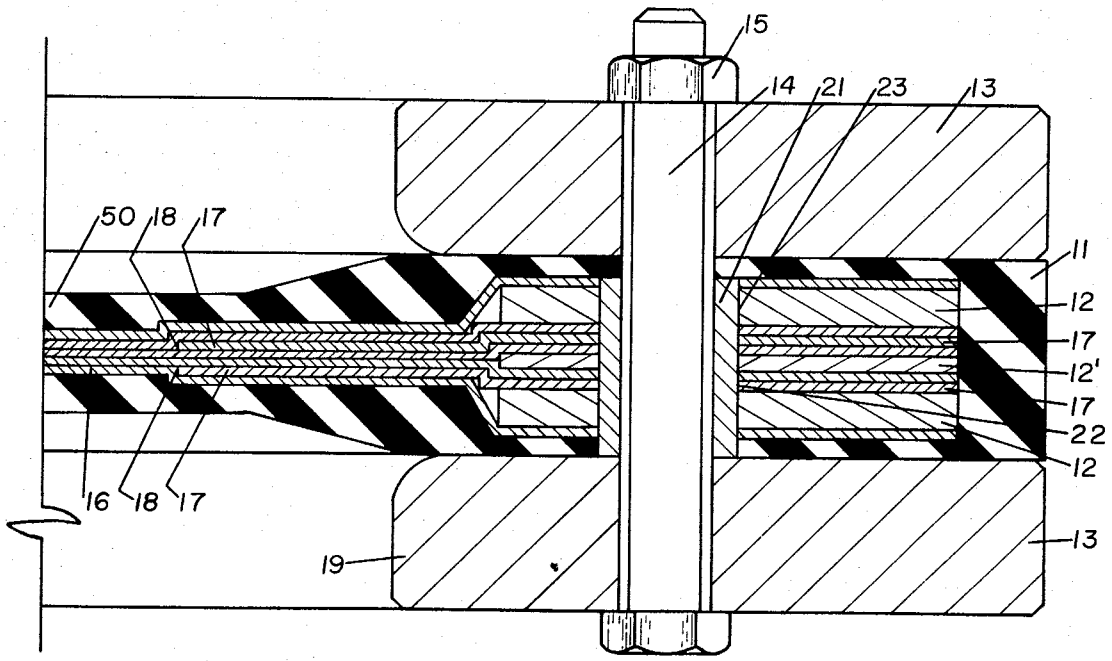
FIG. 4 is an enlarged broken cross-sectional view of a second embodiment of the present invention.

Referring to FIG. 4, a second embodiment of the present invention is shown. The diaphragm 50 is similar in construction to the diaphragm 10 described hereinbefore except for the cross-sectional thickness of the reinforcing member 12' in comparison with the cross-sectional thickness of the adjacent reinforcing members 12 in the outer periphery 11 of the diaphragm 50. The reinforcing member 12' is formed of material having a smaller cross-sectional thickness than reinforcing members 12. For example, the reinforcing members 12 can be formed having a one-quarter inch cross-sectional thickness and a two and one-half inch cross-sectional width, whereas the reinforcing member 12' can be formed of twelve (12) gauge sheet metal which has a thickness of 0.104 inches on the SWG standard for sheet metal thickness of uncoated steel sheets.

It should be noted that since the reinforcing member 12' is of less thickness than that of reinforcing member 12 in the outer periphery 11 of the diaphragm 50, the diaphragm 50 shown in FIG. 4 is more economical to construct than diaphragm 10.

Figure 5:
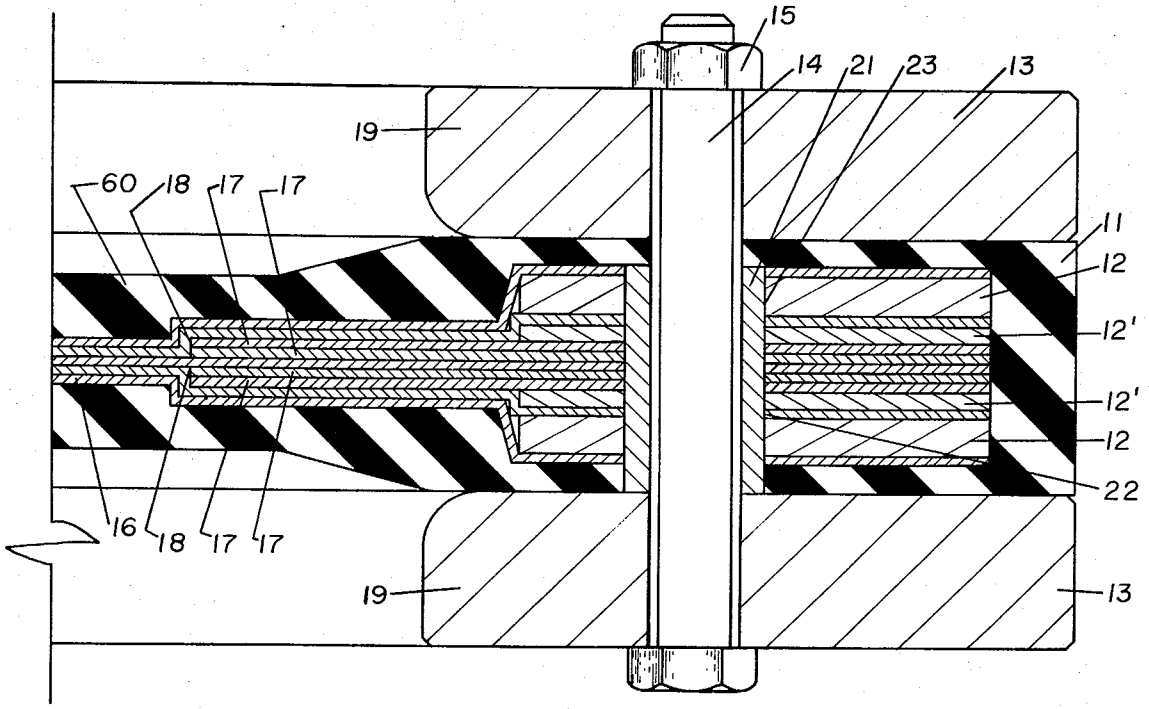
FIG. 5 is an enlarged broken cross-sectional view of a third embodiment of the present invention.

Referring to FIG. 5, a third embodiment of the present invention is shown. The diaphragm 60 is similar in construction to the diaphragm 10 described hereinbefore except for the number and thickness of the reinforcing members 12' in comparison with the cross-sectional thickness of adjacent reinforcing members 12 in the outer periphery 11 of the diaphragm 60 and the number of layers 17 of fabric reinforcing the diaphragm 60.

As shown in FIG. 5, the outer periphery 11 of the diaphgram 60 contains first reinforcing members 12 and second reinforcing members 12' being of less thickness than that of first reinforcing members 12 and being located between the first reinforcing members 12. The outer periphery 11 of the diaphragm 60 also contains a plurality of layers 17 of fabric on either side of the central layer 16 of fabric to reinforce the diaphragm 60.

The diaphragm 60 offers the advantage over diaphragms 10 and 50 shown in FIGS. 3 and 4 respectively of having a stronger outer periphery 11 to resist tearing of the layers 16 and 17 of fabric therein, since there are more layers 17 of fabric therein to reinforce the outer periphery 11 and since there are a plurality of second reinforcing members 12' in the outer periphery 11 to provide more metal reinforcing members, thereby increasing the available bonding area for the layers 16 and 17 of fabric in the outer periphery 11 and increasing the amount of metal in the outer periphery 11, thereby increasing the strength of the outer periphery 11.

Similar to the diaphragm 50 shown in FIG. 4, the first reinforcing members 12 can be formed having a one-quarter inch cross-sectional thickness and a two and one-half inch cross-sectional width, whereas the second reinforcing member 12' can be formed of twelve (12) gauge sheet metal which has a thickness of 0.104 inches on the SWG standard for sheet metal thickness of uncoated steel sheets.

It should be noted that since the second reinforcing members 12' are of less thickness than that of first reinforcing members 12 in the outer periphery 11 of the diaphragm 60, the diaphragm 60 is more economical to construct than if all reinforcing members were the same thickness as first reinforcing members 12.

Figure 6:
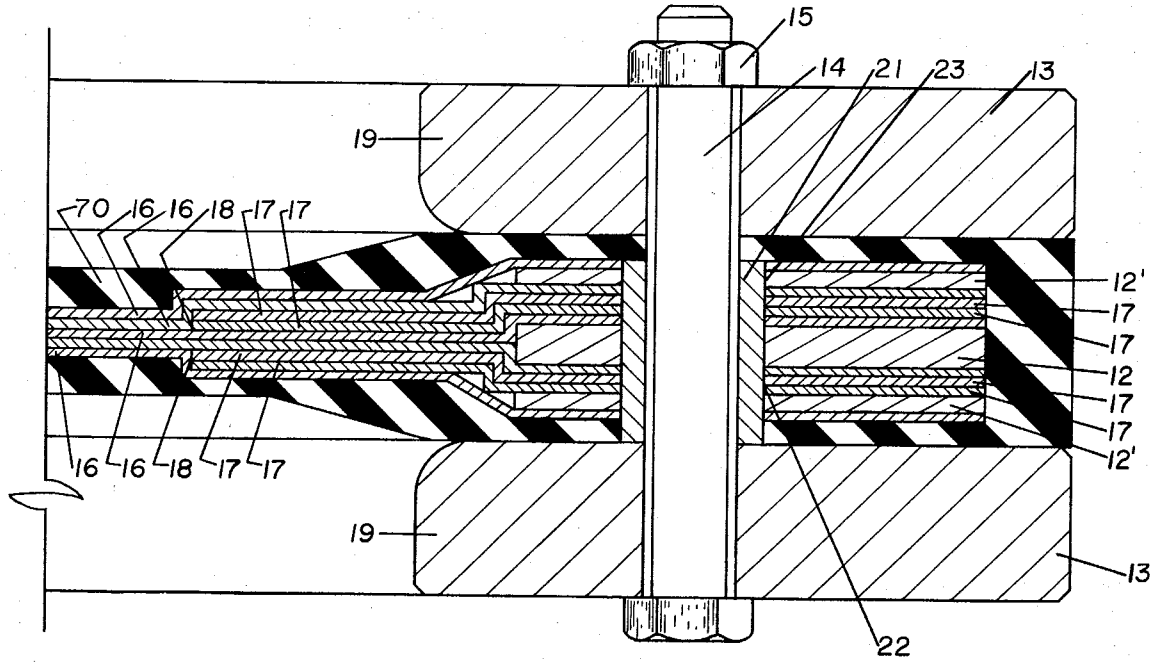
FIG. 6 is an enlarged broken cross-sectional view of a fourth embodiment of the present invention.

Referring to FIG. 6, a fourth embodiment of the present invention is shown. The diaphragm 70 is similar in construction to the diaphragm 10 described hereinbefore except for the number and thickness of the second reinforcing members 12' in comparison with the cross-sectional thickness of adjacent reinforcing members 12 in the outer periphery 11 of the diaphragm 70 and the number of layers 17 of fabric reinforcing the diaphragm 70.

As shown in FIG. 6, the outer periphery 11 of the diaphragm 70 contains first reinforcing members 12 and second reinforcing members 12' being of less thickness than that of first reinforcing member 12 and being located on either side of first reinforcing member 12 adjacent thereto. The outer periphery 11 of the diaphragm 70 also contains a plurality of layers 17 of fabric located between the first reinforcing member 12 and second reinforcing members 12' having layers 16 of fabric bonded thereto respectively to reinforce the diaphragm 70.

Similar to the diaphragm 50 shown in FIG. 4, the first reinforcing member 12 can be formed having a one-quarter inch cross-sectional thickness and a two and one-half inch cross-sectional width, whereas the second reinforcing members 12' can be formed of twelve (12) gauge sheet metal which has a thickness of 0.104 inch on the SWG standard for sheet metal thickness of uncoated steel sheet.

It should be noted that since the second reinforcing members 12' are of less thickness than that of first reinforcing member 12 in the outer periphery 11 of the diaphragm 70, the diaphragm 70 is more economical to construct than if all reinforcing members were the same thickness as first reinforcing members 12. However, it should also be noted that since the outer periphery 11 of the diaphragm 70 contains first reinforcing member 12 and second reinforcing members 12' which have a total thickness that is less than the total metal thickness of the first reinforcing members 12 and second reinforcing members 12' contained in the outer periphery 11 of diaphragms 50 and 60 in FIGS. 4 and 5 respectively, and of less total thickness than the total metal thickness of reinforcing members 12 contained in the outer periphery 11 of diaphragm 10 in FIG. 3, the outer periphery 11 of diaphragm 70 inherently cannot be as strong as the outer periphery 11 of diaphragms 10, 50 and 60 described hereinbefore.

It is to be clearly understood that the construction of diaphragms 10, 50, 60 and 70 is identical except for the number of layers 17 of fabric reinforcing the diaphragms and the number and cross-sectional thickness of the reinforcing members in the outer periphery of the diaphragm. It is also to be clearly understood that while the present invention has been illustrated with respect to diaphragms having five (5) layers 16 of fabric reinforcing the diaphragm, any number of layers 16 of fabric reinforcing the diaphragm may be utilized, as well as any number of layers 17 of fabric and any number and combination of thicknesses of first and second reinforcing members, in the outer periphery of the diaphragm.

It should further be understood that the diaphragms 10, 50, 60 and 70 may be formed without bushings 20 or holes in the outer periphery 11 thereof and merely be retained on the jacket leg or skirt pile sleeve of an offshore platform by means of two annular plates having flat confronting faces with inwardly tapered enlarged ends to retain the diaphragm therebetween by means of an interference fit therewith, although this embodiment has not been illustrated in the drawings herein.

From the foregoing, it should be readily apparent that the present invention offers important advantages over the prior art.

The diaphragm is easily constructed utilizing simple stacking techniques to secure the layers of fabric to each other and the reinforcing members in the outer periphery of the diaphragm.

The diaphragm does not require any wrapping of the layers of fabric about the reinforcing members in the outer periphery of the diaphragm.

The diaphragm contains extra layers of fabric in the outer periphery of the diaphragm to provide additional strength in highly stressed areas of diaphragm loading such as the inner diameter of the annular flat plates retaining the diaphragm on the jacket leg or pile guide sleeve of an offshore platform.

The annular flat plates retaining the diaphragm have simple shapes requiring little machining for use.

The diaphragm is positively retained between the annular flat plates to prevent release therefrom.

The diaphragm is of a reinforced type capable of withstanding relatively high pressures over relatively large areas while remaining readily frangible by a piling driven therethrough without requiring the addition of cutting members in the diaphragm.

The metal reinforcing members in the periphery of the diaphragm are simple geometric shapes which can be easily constructed.

Having thus described my invention, I claim:

1. In combination, a diaphragm and annular diaphragm retaining means retaining said diaphragm therein, said diaphragm comprising:

flexible member means having a peripheral portion and an inner portion;

annular substantially rectangular cross-sectionally shaped reinforcing member means located in the peripheral portion of said flexible member means;

first reinforcing means having a peripheral portion bonded to said reinforcing member means and extending through the peripheral portion and through the inner portion of said flexible member means; and second reinforcing means having a peripheral portion secured in the peripheral portion of said flexible member means and extending inwardly into the inner portion of said flexible member means and terminating inwardly of said reinforcing member means and the inner diameter of said annular diaphragm retaining means with said second reinforcing means overlaying a portion of the inner portion of said reinforcing means, whereby when said diaphragm is deformed into engagement with the inner diameter of said annular diaphragm retaining means, said second reinforcing means provides additional reinforcement to said diaphragm in the portion of said diaphragm deformed into engagement with said annular diaphragm retaining means.

2. The combination of claim 1 wherein:

said annular substantially rectangular cross-sectionally shaped reinforcing member means comprises a plurality of annular reinforcing member means;

said first reinforcing means comprises a plurality of layers of reinforcing means; and said second reinforcing means comprises a plurality of layers of reinforcing means.

3. The combination of claim 2 wherein:

the plurality of annular reinforcing member means comprises a plurality of annular reinforcing member means, each annular reinforcing member means having substantially the same cross-sectional thickness.

4. The combination of claim 2 wherein:

the plurality of annular reinforcing member means comprises a plurality of annular reinforcing member means with at least one of the annular reinforcing member means having a cross-sectional thickness substantially less than that of the cross-sectional thickness of other annular reinforcing member means of the plurality.

5. The combination of claim 1 wherein:

said first reinforcing means comprises a plurality of layers of fabric reinforcing means; and said second reinforcing means comprises a plurality of layers of fabric reinforcing means.

6. The combination of claim 2 wherein:

said diaphragm is retained by said diaphragm retaining means by means of a plurality of fasteners extending through said diaphragm retaining means, through said flexible member means, through said first reinforcing means of said diaphragm, through said second reinforcing member means of said diaphragm and through said reinforcing member means of said diaphragm.

7. The combination of claim 2 wherein:

said diaphragm is retained by said diaphragm retaining means by means of an interference fit therein.

8. In combination, a diaphragm and annular diaphragm retaining means retaining said diaphragm therein, said diaphragm comprising:

flexible member means having a peripheral portion and an inner portion;

annular substantially rectangular cross-sectionally shaped reinforcing member means located in the peripheral portion of said flexible member means;

first reinforcing means having a peripheral portion bonded to said reinforcing member means and extending through the peripheral portion and through the inner portion of said flexible member means, said first reinforcing means comprising:

a plurality of layers of reinforcing means;

second reinforcing means having a peripheral portion secured in the peripheral portion of said flexible member means and extending inwardly into the inner portion of said flexible member means and terminating inwardly of said reinforcing member means and the inner diameter of said annular diaphragm retaining means with said second reinforcing means overlaying a portion of the inner portion of said reinforcing means, said second reinforcing means comprising:

a plurality of layers of reinforcing means; whereby said diaphragm is retained by said diaphragm retaining means by means of a plurality of fasteners extending through said diaphragm retaining means, through said flexible member means, through said first reinforcing means of said diaphragm, through said second reinforcing member means of said diaphragm and when said diaphragm is deformed into engagement with the inner diameter of said annular diaphragm retaining means, said second reinforcing means provides additional reinforcement to said diaphragm in the portion of said diaphragm deformed into engagement with said annular diaphragm retaining means.

9. The combination of claim 8 wherein:

the plurality of annular reinforcing member means comprises a plurality of annular reinforcing member means, each annular reinforcing member means having substantially the same cross-sectional thickness.

10. The combination of claim 8 wherein:

the plurality of annular reinforcing member means comprises a plurality of annular reinforcing member means with at least one of the annular reinforcing member means having a cross-sectional thickness substantially less than that of the cross-sectional thickness of other annular reinforcing member means of the plurality.

11. In combination, a diaphragm and annular diaphragm retaining means retaining said diaphragm therein, said diaphragm comprising:

flexible member means having a peripheral portion and an inner portion;

annular substantially rectangular cross-sectionally shaped reinforcing member means located in the peripheral portion of said flexible member means;

first reinforcing means having a peripheral portion bonded to said reinforcing member means and extending through the peripheral portion and through the inner portion of said flexible member means, said first reinforcing means comprising:

a plurality of layers of reinforcing means;

second reinforcing means having a peripheral portion secured in the peripheral portion of said flexible member means and extending inwardly into the inner portion of said flexible member means and terminating inwardly of said reinforcing member means and the inner diameter of said annular diaphragm retaining means with said second reinforcing means overlaying a portion of the inner portion of said reinforcing means, said second reinforcing means comprising:

a plurality of layers of reinforcing means;

whereby said diaphragm is retained by said diaphragm retaining means by means of an interference fit therein and when said diaphragm is deformed into engagement with the inner diameter of said annular diaphragm retaining means, said second reinforcing means provides additional reinforcement to said diaphragm in the portion of said diaphragm deformed into engagement with said annular diaphragm retaining means.

12. The combination of claim 11 wherein:

the plurality of annular reinforcing member means comprises a plurality of annular reinforcing member means, each annular reinforcing member means having substantially the same cross-sectional thickness.

13. The combination of claim 11 wherein:

the plurality of annular reinforcing member means comprises a plurality of annular reinforcing member means with at least one of the annular reinforcing member means having a cross-sectional thickness substantially less than that of the cross-sectional thickness of other annular reinforcing member means of the plurality.

14. In combination, a diaphragm and an annular diaphragm retaining means retaining said diaphragm therein for closing the bore of a tubular support member of a marine platform or a similar structure, said diaphragm comprising:

flexible member means having a peripheral portion and an inner portion;

annular substantially rectangular cross-sectionally shaped reinforcing member means located in the peripheral portion of said flexible member means;

first reinforcing means having a peripheral portion bonded to said reinforcing member means and extending through the peripheral portion and through the inner portion of said flexible member means;

second reinforcing means having a peripheral portion secured in the peripheral portion of said flexible member means and extending inwardly into the inner portion of said flexible member means and terminating inwardly of said reinforcing member means and the inner diameter of said annular diaphragm retaining means with said second reinforcing means overlaying a portion of the inner portion of said reinforcing means; and said annular diaphragm retaining means comprising a pair of annular plates releasably secured to each other retaining said diaphragm therebetween, said annular diaphragm retaining means having one of said pair of annular plates secured to the bottom of said tubular support member of said marine platform or similar structure, thereby closing said bore of said tubular support or similar structure by said diaphragm and said diaphragm retaining means being installed thereon;

whereby when said diaphragm is deformed into engagement with the inner diameter of said annular diaphragm retaining means, said second reinforcing means provides additional reinforcement to said diaphragm in the portion of said diaphragm deformed into engagement with said annular diaphragm retaining means.

15. The combination of claim 14 wherein:

said annular substantially rectangular cross-sectionally shaped reinforcing member means comprises a plurality of annular reinforcing member means;

said first reinforcing means comprises a plurality of layers of reinforcing means; and said second reinforcing means comprises a plurality of layers of reinforcing means.

16. The combination of claim 15 wherein:

the plurality of annular reinforcing member means comprises a plurality of annular reinforcing member means, each annular reinforcing member means having substantially the same cross-sectional thickness.

17. The combination of claim 15 wherein:

the plurality of annular reinforcing member means comprises a plurality of annular reinforcing member means with at least one of the annular reinforcing member means having a cross-sectional thickness substantially less than that of the cross-sectional thickness of other annular reinforcing member means of the plurality.

18. The combination of claim 14 wherein:

said first reinforcing means comprises a plurality of layers of fabric reinforcing means, and said second reinforcing means comprises a plurality of layers of fabric reinforcing means.

19. The combination of claim 15 wherein:

said diaphragm is retained by said diaphragm retaining means by means of a plurality of fasteners extending through said diaphragm retaining means, through said flexible member means, through said first reinforcing means of said diaphragm, through said second reinforcing member means of said diaphragm and through said reinforcing member means of said diaphragm.

20. The combination of claim 15 wherein:

said diaphragm is retained by said diaphragm retaining means by means of an interference fit therein.

21. In combination, a diaphragm and an annular diaphragm retaining means retaining said diaphragm therein for closing the bore of a tubular support member of a marine platform or a similar structure, said diaphragm comprising:

flexible member means having a peripheral portion and an inner portion;

annular substantially rectangular cross-sectionally shaped reinforcing member means located in the peripheral portion of said flexible member means;

first reinforcing means having a peripheral portion bonded to said reinforcing member means and extending through the peripheral portion and through the inner portion of said flexible member means, said first reinforcing means comprising:

a plurality of layers of reinforcing means;

second reinforcing means having a peripheral portion secured in the peripheral portion of said flexible member means and extending inwardly into the inner portion of said flexible member means and terminating inwardly of said reinforcing member means and the inner diameter of said annular diaphragm retaining means with said second reinforcing means overlaying a portion of the inner portion of said reinforcing means, said second reinforcing means comprising:

a plurality of layers of reinforcing means; and said annular diaphragm retaining means comprising a pair of annular plates releasably secured to each other retaining said diaphragm therebetween, said annular diaphragm retaining means having one of said pair of annular plates secured to the bottom of said tubular support member of said marine platform or similar structure, thereby closing said bore of said tubular support or similar structure by said diaphragm and said diaphragm retaining means being installed thereon;

whereby when said diaphragm is deformed into engagement with the inner diameter of said annular diaphragm retaining means, said second reinforcing means provides additional reinforcement to said diaphragm in the portion of said diaphragm deformed into engagement with said annular diaphragm retaining means.

22. The combination of claim 21 wherein:

said diaphragm is retained by said diaphragm retaining means by means of a plurality of fasteners extending through said diaphragm retaining means, through said flexible member means, through said first reinforcing means of said diaphragm, through said second reinforcing member means of said diaphragm and through said reinforcing member means of said diaphragm.

23. The combination of claim 21 wherein:

said diaphragm is retained by said diaphragm retaining means by means of an interference fit therein.

* * * * *